US006106641A

United States Patent [19]

Nishikawa et al.

[11] Patent Number: 6,106,641

[45] Date of Patent: Aug. 22, 2000

[54] ALUMINUM ALLOY SHEET FOR CROSS FIN AND PRODUCTION THEREOF

[75] Inventors: Yasuhisa Nishikawa; Takahiko Watai, both of Shizuoka, Japan

[73] Assignee: NipponLight Metal Company, Ltd., Tokyo, Japan

[21] Appl. No.: 09/057,917

[22] Filed: Apr. 9, 1998

[30] Foreign Application Priority Data

May 8, 1997 [JP] Japan ..... 9-132977

[51] Int. Cl.[7] ..... C22C 21/00; C22F 1/04

[52] U.S. Cl. ..... 148/551; 148/437; 148/552; 420/548; 420/550

[58] Field of Search ..... 148/437, 551, 148/552; 420/548, 550

[56] References Cited

U.S. PATENT DOCUMENTS 5,554,234 9/1996 Takeuchi et al. ..... 148/551

FOREIGN PATENT DOCUMENTS 5-156412 6/1993 Japan .
8-327291 12/1996 Japan .

*Primary Examiner*—George Wyszomierski
*Assistant Examiner*—Janelle Combs Morillo
*Attorney, Agent, or Firm*—McAulay Nissen Goldberg & Kiel, LLP

[57] ABSTRACT

A continuous-cast and cold-rolled aluminum alloy sheet for a cross fin, characterized by a chemical composition consisting of not less than 0.05 wt % and less than 0.30 wt % Fe, more than 0.03 wt % and less than 0.10 wt % Mn, an amount of a grain refining agent, and the balance of Al and unavoidable impurities including less than 0.15 wt % Si; a microstructure substantially composed of subgrains; and an electrical conductivity of 55% IACS or more. The aluminum alloy sheet is advantageously produced by a process including the steps of continuous-casting an aluminum alloy melt having the above-mentioned chemical composition to form a cast sheet having a sheet thickness of not more than 30 mm; cold-rolling the cast sheet at a reduction of 90% or more, followed by a temper annealing at a temperature of from 250 to 300° C. for a holding time of 2 hours or more. The present inventive aluminum alloy sheet has a high formability such that a cross fin having a large fin pitch applicable to any type of heat media pipe having various sizes can be successfully formed by a simplified production process which is easy to manage and also reduces the production cost, and by using less viscous volatile lubricants causing no substantial environmental pollution.

2 Claims, 1 Drawing Sheet

ALUMINUM ALLOY SHEET FOR CROSS FIN AND PRODUCTION THEREOF

BACKGROUND OF THE INVENTION

1. Field of the Invention

The present invention relates to an aluminum alloy sheet for a cross fin and a process of producing same.

2. Description of the Related Art

Heat exchangers are essentially composed of a heat media pipe for circulation of heat transfer media, such as water or air, and a fin placed in close contact with the pipe to exchange heat with the environment, and are manufactured by various types of production processes.

Heat exchangers produced by bonding a heat media pipe and a fin by soldering have a strong bond resistance to vibration and are suitably used for the radiator of automobile but have a drawback that the bonding process requires a high temperature close to 600° C. to melt a solder and the production cost is therefore increased.

Heat exchangers designed for air conditioners or refrigerators are produced by bonding a heat media pipe and a fin by a mechanical process, which is less expensive than soldering. The fin is made from a thin sheet having a thickness of 100 to 150 $\mu$m by forming therein a through hole having a diameter corresponding to that of a heat media pipe, and the pipe is then fitted in the through hole to bond the pipe and the fin. This type of fin having a through hole in which a heat media pipe is to be fitted is called "cross fin". A large number of cross fins are stacked at a space therebetween, for example, 1 to 2 mm, with the through holes thereof being aligned in an array for engagement with the pipe to form a heat exchanger.

The through hole of the cross fin is formed so as to have a circumuferential wall or a collar which extends from, and perpendicularly to, the fin surface to a height and has an edge lip or a flare radially extending outward in order to ensure provision of a selected space between the fins when stacked and a good mechanical bond and heat transfer between the fin and the pipe.

Because of a good formability and heat conductivity, aluminum and aluminum alloys are used as a material of cross fins. The collar having an outward extending edge flare is typically formed by the following processes I, II, or III.

I. The draw process, in which a sheet of aluminum or an aluminum alloy (hereinafter simply referred to as "aluminum sheet") is first deep-drawn to form a bulge having a diameter greater than that of the heat media pipe and a large height, further deep-drawn in three or four steps to reduce the diameter and the height of the bulge to define a collar by an annular wall of the bulge, pierced (to open a through hole) and burred (to expand the through hole) to form a through hole for engagement with the heat media pipe, and finally reflared (to extend the collar end radially outward).

II. The drawless process, in which an aluminum sheet is first pierced and burred to form a through hole, then ironed in two steps to reduce the sheet thickness and form a collar portion, and finally reflared.

III. The combination process, in which a sheet is first deep-drawn by the first one or two steps of the draw process, pierced and burred to form a through hole having a collar lower than a designed height, ironed to provide the collar with a correct height, and finally reflared.

The draw process if mostly carried out by deep drawing, requiring good ductility to the work, and uses a soft aluminum sheet.

The drawless process forms a collar by ironing and allows the use of a hard aluminum sheet. However, the ironing die is subjected to significant wear under the presence of a volatile lubricant.

The combination process reduces the die wear by combining deep drawing and ironing.

The cross fins are conventionally produced by these processes from an aluminum sheet, which has a good heat conductivity and formability.

To provide an aluminum sheet having an improved strength and bore expandability, Japanese Unexamined Patent Publication (Kokai) No. 5-156412 proposed a process in which a continuous-cast sheet containing 0.01 to 0.15 wt % Si, 0.05 to 0.040 wt % Fe, 0.10 to 0.50 wt % Mn, and the balance consisting of Al and unavoidable impurities is cold-rolled at a reduction of 80% or more and the cold-rolled sheet is temper-annealed at a temperature of 230 to 330° C.

To provide an aluminum alloy sheet having good strength, ductility and formability, Japanese Unexamined Patent Publication (Kokai) No. 8-327291 proposed a process in which a continuous-cast and rolled sheet containing Fe and Ti in selected amounts is intensely cold-rolled and temper-annealed to bring a selected amount of Fe into solid solution and also to provide a combined microstructure composed of subgrains and recrystallized grains mixed with subgrains in the mid-thickness zone of the sheet.

The fin forming process including the aforementioned deep-drawing, reflaring, and ironing is a precise die forming process in which a low friction lubricant is necessary to ensure good formability. The low friction lubricant has a viscosity as high as 7 to 8 cSt and requires a special treatment agent for the removal thereof from the formed fin, causing an unacceptable pollution of the environment.

To avoid the use of a special treatment agent for removal of lubricant, it has been proposed to use a volatile lubricant such as gasoline, which, however, causes the forming to be difficult.

The aluminum sheet produced by the process of Japanese Unexamined Patent Publication (Kokai) No. 5-156412 has a poor bore expandability and application flexibility in view of the recent antipollution requirements. In the heat exchangers designed for air conditioners or refrigerators, the heat media pipes have various sizes and the aluminum sheet for the fin use must has a high formability sufficient to provide a large fin pitch (or a reflared collar having a large height) fittable to any size of heat media pipes. The aluminum sheet of Japanese Unexamined Patent Publication (Kokai) No. 5-156412, when used with a volatile lubricant, has a poor fin formability, causes cracking to occur at the collar end during reflaring, cannot be used when a heat media pipe has a small outer diameter because the bore expandability with respect to the outer diameter is necessarily large, fails to provide good bond to the heat media pipe, and provides a poor appearance.

The aluminum sheet produced by the process of Japanese Unexamined Patent Publication (Kokai) No. 8-327291 has a poor temper annealing property, i.e., has a large scatter of strength when temper-annealed under a wide selection of the temper annealing conditions including heating temperature and time.

SUMMARY OF THE INVENTION

The present inventors conducted various studies to solve the above-mentioned problems of the prior art and found that reduced contents of Fe and Si together with the presence of a selected amount of Mn combinedly allow a wider selection of the temper annealing conditions for providing a semi-hard aluminum alloy sheet, substantially composed of subgrains, which only includes less than 1% recrystallized grains over the sheet thickness and is advantageously applicable to forming of a cross fin having a large fin pitch, particularly by any type of the drawless and combined processes or by some types of draw processes.

According to the present invention, there is provided a continuous-cast and cold-rolled aluminum alloy sheet for a cross fin, characterized by:

a chemical composition consisting of not less than 0.05 wt % and less than 0.30 wt % Fe, more than 0.03 wt % and less than 0.10 wt % Mn, an amount of a grain refining agent, and the balance of Al and unavoidable impurities including less than 0.15 wt % Si;

a microstructure substantially composed of subgrains; and an electrical conductivity of 55% IACS or more.

There is also provided, according to the present invention, a process of producing a continuous-cast and cold-rolled aluminum alloy sheet for a cross fin, characterized by the steps of:

preparing an aluminum alloy melt having a chemical composition consisting of not less than 0.05 wt % and less than 0.30 wt % Fe, more than 0.03 wt % and less than 0.10 wt % Mn, an amount of a grain refining agent, and the balance of Al and unavoidable impurities including less than 0.15 wt % Si;

continuous-casting the aluminum alloy melt to form a cast sheet having a sheet thickness of not more than 30 mm;

cold-rolling the cast sheet, at a reduction of 90% or more, followed by a temper annealing at a temperature of from 250 to 300° C. for a holding time of 2 hours or more.

DESCRIPTION OF THE PREFERRED EMBODIMENTS

Figure 1A:
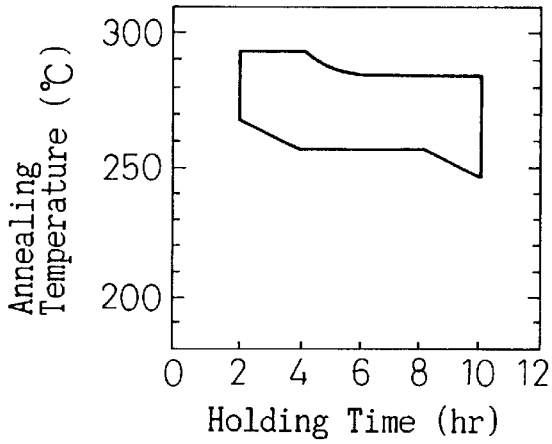
FIGS. 1A, 1B and 1C are graphs showing the range of temper annealing temperature and time providing a desirable tensile strength of 130 to 150 MPa for the present inventive sheets (FIGS. 1A, 1B) and the comparative sheets (FIG. 1C), respectively.

The aluminum alloy sheet according to the present invention is essentially defined by the chemical composition, the microstructure, and the electrical conductivity, as will be described in detail, in that order, below.

Chemical Composition $0.05 \leqq Fe < 0.30$ wt %

Fe must be present in an amount of not less than 0.05 wt % and less than 0.30 wt % in order that Fe is present in the form of fine intermetallic compounds and in solid solution during continuous casting and cold rolling steps to ensure provision of a high strength and fin formability and that a uniform subgrain structure over the sheet thickness is established during the subsequent temper annealing step.

If the Fe content is less than 0.05 wt %, the above-mentioned effect, particularly the sheet strength, cannot be obtained.

If the Fe content is 0.30 wt % or more, 5 μm or coarser intermetallic compounds are formed and not only reduce the formability but also cause recrystallization to preferentially occur in the vicinity thereof during temper annealing with the result that 1% or more recrystallized grains are generated and a microstructure substantially composed of subgrains cannot be obtained.

$0.03 < Mn < 0.10$ wt %

Mn must be present in an amount of more than 0.03 wt % and less than 0.10 wt % in order that a high formability necessary to provide a large fin pitch is stably obtained and a desired strength can be also obtained even under a wide selection of the temper annealing conditions including heating temperature and time, i.e., the temper annealing can be easily carried out.

If the Mn content is 0.03 wt % or less, the above-mentioned effect cannot be obtained.

If the Mn content is 0.10 wt % or more, a high formability necessary to provide a large fin pitch cannot be obtained and the heat conductivity is also reduced.

The Mn content is preferably 0.05 wt % or more.

Grain Refining Agents: Ti, B, etc.

The grain refining agents, represented by Ti and B, refine crystal grains during continuous casting and prevent casting cracking from occurring. This effect is not significant when the Ti content is less than 0.001 wt %. When the Ti content is more than 0.02 wt %, the heat conductivity is low. Ti is preferably present in an amount of less than 0.015 wt %. Ti is preferably introduced in the present inventive alloy by using an additive material in the form of an Al—Ti mother alloy. Ti and B are preferably introduced in the present inventive alloy by using an additive material in the form of an Al—Ti—B mother alloy. B does not affect the properties of the present inventive sheet when present in an amount of not more than 0.002 wt %.

Unavoidable Impurities

To ensure good heat conductivity, formability, and corrosion resistance, the amounts of impurity elements must be as low as possible. Typically the Si content must be less than 0.15 wt % to suppress formation of coarse intermetallic compounds and, preferably, the Cu content is less than 0.15 wt % and the Cr, V, and Zr contents are each less than 0.015 wt %.

In combination with the above-described less than 0.30 wt % Fe and less than 0.10 wt % Mn, the reduced impurity contents, particularly less than 0.15 wt % Si, enables temper annealing to be easily performed, regulates coarsening of intermetallic compounds, establishes a microstructure substantially composed of subgrains only including recrystallized grains in a limited amount of less than 1% over the sheet thickness, and ensures satisfactory forming cross fin with a large fin pitch even when using a volatile lubricant.

Microstructure

The microstructure is substantially composed of subgrains and does not contain 5 μm or larger intermetallic compounds. The aluminum sheet according to the present invention is produced by cold-rolling a continuous-cast sheet to ensure that Mn and other alloying elements are brought into solid solution in an increased amount to advantageously facilitate control of the sheet strength by temper annealing.

Electrical Conductivity

The present inventive aluminum sheet must have an electrical conductivity of 55% IACS or greater to ensure good heat conduction for fabricating heat exchangers having good performance.

The process of producing an aluminum alloy sheet according to the present invention is essentially defined by the thickness of the continuous-cast sheet, the reduction by cold rolling, and the condition of temper annealing, as will be described in detail in that order below.

Continuous Casting

Any continuous casting process can be used so long as a cast sheet can be obtained by rapid cooling and solidification and the cast sheet can be continuously cold-rolled to form a cold-rolled sheet. For example, a water-cooled roll process includes pouring an aluminum melt in a gap between a pair of rotating rolls which are internally water-cooled to form a cast sheet and cold-rolling the cast sheet without precedent annealing. Another process includes pouring an aluminum melt in a gap between a pair of rotating plates which are water-cooled from the back side to form a cast sheet and cold-rolling the cast sheet without precedent annealing.

The continuous casting may be carried out, for example, by pouring a melt held at a temperature of 680 to 730° C. in a casting mold while withdrawing a cast sheet from the bottom of the mold. The cast sheet has a thickness of 30 mm or less, preferably 10 mm or less, which is obtained by hot or warm rolling immediately after casting, which rolling phase forms the last part of the continuous casting process. If the cast sheet has a thickness of more than 30 mm, coarse intermetallic compounds having a diameter of 5 $\mu$m or more are formed and are not eliminated by the subsequent rolling but cause recrystallized grains to form around the coarse intermetallic compounds, causing failure in producing the present inventive aluminum sheet. The cast sheet is usually withdrawn from the mold bottom at a speed of 50 to 150 cm/min.

Cold Rolling

The thus-produced cast sheet is then cold-rolled at a reduction of 90% or more, which, in combination with the chemical composition and the cast sheet thickness, ensures that a uniform subgrain structure is formed by temper annealing.

Temper Annealing

After the cold rolling at a reduction of 90% or more, temper annealing is carried out at a temperature of 250 to 300° C. for a holding time of 2 hours or more. The temper annealing, in combination with the cold rolling at a reduction of 90% or more, converts worked structure to a uniform subgrain structure to provide an excellent formability and an electrical conductivity of 55% IACS ensuring good heat conductivity. If any of the cold rolling reduction of 90% or more, the temper annealing temperature of 250° C. or more, and the temper annealing time of 2 hours or more is not satisfied, conversion of the worked structure is not successfully effected and may cause a failure in providing both or either of a good formability and an electrical conductivity of 55% IACS or more. If the temper annealing temperature is higher than 300° C., the sheet contains recrystallized grains in an amount of 1% or more and it is difficult to provide the present inventive sheet having a microstructure substantially composed of subgrains. The temper annealing time is not preferably more than 10 hours from economical point of view.

EXAMPLES

Example 1

The inventive and comparative aluminum alloy melts having the chemical compositions (wt %) within, or outside, the present inventive range as summarized in Table 1 were continuous-cast by a water-cooled roll process to form 7 mm thick cast sheets, which were then cold-rolled to 0.100 mm thick cold-rolled sheets (rolling reduction: 99%).

TABLE 1

Figure 1B:
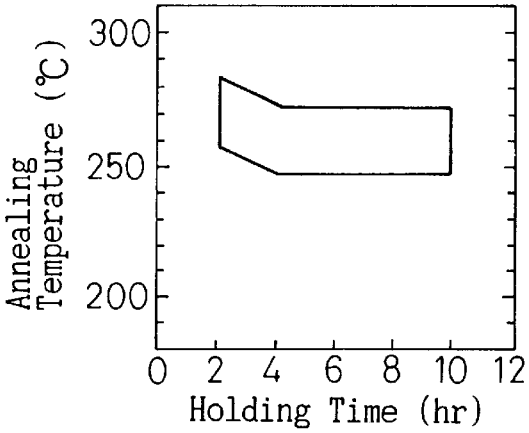
Figure 1C:
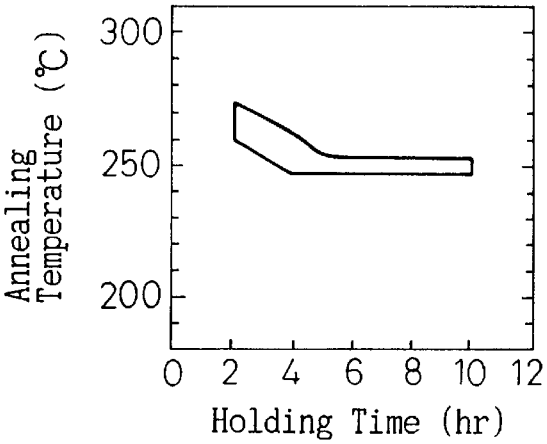

| | Alloy | Si | Fe | Ti | Mn | B | Al + imp. | Remarks |
|---|---|---|---|---|---|---|---|---|
| Invention | A | 0.09 | 0.16 | 0.013 | 0.08 | 0.001 | Bal. | FIG. 1A |
| | B | 0.11 | 0.25 | 0.010 | 0.04 | 0.001 | Bal. | FIG. 1B |
| Comparison | C | 0.08 | 0.18 | 0.016 | 0.002* | 0.002 | Bal. | FIG. 1C |

Note: -"imp." means impurities other than those shown in Table 1.
-Ti is introduced by using an Al-5 wt % Ti-1 wt % B mother alloy.
-"*" means "outside the inventive range".

The thus-produced aluminum sheets were temper-annealed at temperatures of from 250 to 300° C. for holding times of from 2 to 10 hours. FIGS. 1A, 1B and 1C show the range of the temper annealing temperature and time which provide a desired tensile strength of 130 to 150 MPa for alloys A, B and C, respectively. As can be seen from FIGS. 1A and 1B showing the data of alloys A and B of the present invention, in comparison with FIG. 1C showing the data of comparative alloy C containing less amount of Mn, temper annealing can be carried out in a wider temperature range, i.e., ensures provision of the desired tensile strength even under substantial variation in the temper annealing temperature, and thus facilitates temper annealing.

Example 2

The inventive and comparative aluminum alloy melts having the chemical compositions (wt %) within, or outside, the present inventive range as summarized in Table 2 were continuous-cast by a water-cooled roll process to form 7 mm thick cast sheets, which were then cold-rolled to 0.100 mm thick cold-rolled sheets (rolling reduction: 99%).

TABLE 2

| | Alloy | Si | Fe | Ti | Mn | B | Al + imp. |
|---|---|---|---|---|---|---|---|
| Invention | D | 0.07 | 0.09 | 0.008 | 0.06 | 0.001 | Bal. |
| | E | 0.09 | 0.19 | 0.010 | 0.08 | 0.001 | Bal. |
| | F | 0.10 | 0.26 | 0.012 | 0.05 | 0.001 | Bal. |
| Comparison | G | 0.08 | 0.17 | 0.013 | 0.18* | 0.001 | Bal. |
| | H | 0.11 | 0.45* | 0.016 | 0.09 | 0.002 | Bal. |

Note: -"imp." means impurities other than those shown in Table 1.
-Ti is introduced by using an Al-5 wt % Ti-1 wt % B mother alloy.
-"*" means "outside the inventive range".

The thus-produced aluminum sheets were temper-annealed under the conditions shown in Table 3 and then subjected to drawless forming and combined forming to determine the formability. The data are also shown Table 3 in the right end columns. The other properties including the microstructure, the electrical conductivity, and the mechanical properties are also summarized in Table 3.

TABLE 3

| | | Temper annealing | | | | Electrical | Tensile property | | Fin formability | |
|---|---|---|---|---|---|---|---|---|---|---|
| | Alloy | Temp. (° C.) | Time (hr) | Microstructure | Annealing property | conductivity (%IACS) | Strength (MPa) | Elongation (%) | Drawless | Combination |
| Invention | D | 260 | 4 | Subgrains | ○ | 57.2 | 134 | 13.5 | ○ | ○ |
| | E | 260 | 4 | Subgrains | ○ | 56.1 | 149 | 8.6 | ○ | ○ |
| | | 270 | 2 | Subgrains | ○ | 56.2 | 148 | 9.7 | ○ | ○ |
| | | | 4 | Subgrains | ○ | 56.6 | 141 | 13.7 | ○ | ○ |

TABLE 3-continued

| | Alloy | Temper annealing Temp. (° C.) | Temper annealing Time (hr) | Microstructure | Annealing property | Electrical conductivity (%IACS) | Tensile property Strength (MPa) | Tensile property Elongation (%) | Fin formability Drawless | Fin formability Combination |
|---|---|---|---|---|---|---|---|---|---|---|
| | | | 10 | Subgrains | ○ | 56.8 | 136 | 16.0 | ○ | ○ |
| | | 280 | 4 | Subgrains | ○ | 56.6 | 137 | 16.3 | ○ | ○ |
| | | 290 | 5 | Subgrains | ○ | 56.9 | 128 | 18.2 | ○ | ○ |
| | F | 280 | 5 | Subgrains | ○ | 56.3 | 146 | 10.3 | ○ | ○ |
| Comparison | G | 260 | 4 | Subgrains | ○ | 52.0* | 164 | 6.0 | X | Δ |
| | H | 280 | 4 | Recrystallized grains* + Subgrains | ○ | 54.2 | 135 | 12.0 | X | Δ |
| | D | 330 | 4 | Recrystallized grains* | ○ | 59.5 | 105 | 13.2 | X | X |

Note:
"*" means "outside the inventive range".

The properties shown in Table 3 were measured or estimated by the following procedure.

Formability of Collar 100 samples were formed in each of the following forming processes and the forming cracks were detected. A volatile press oil having a viscosity of 1.5 cSt (40° C.) was used as a lubricant during forming. The produced fins had a collar having a final inner diameter of 9.9 mm.

Drawless Process

Cross fins having a fin pitch (i.e., height of reflared collar) of 1.6 mm were produced by ironing in two steps followed by reflaring and reflaring cracks extending from the reflared end to the collar body were detected.

Combination Process

Cross fins having a fin pitch of 1.8 mm were produced by deep drawing in two steps and then ironing in two steps followed by reflaring and reflaring cracks extending from the reflared end to the collar body were detected.

Recrystallized Grains

Cross-sectional samples were mirror-polished, anodized in a 1% aqueous solution of borofluoric acid, and subjected to microscopic observation under a polarized light.

Subgrains

Samples prepared from the surface and mid-thickness portions of the sheets were observed by a transmission electron microscope (TEM).

Electrical Conductivity

The double-bridge method was carried out in accordance with JIS H0505 in an oil bath held at 20° C.

In Table 3, the symbols "○", "Δ", and "x" mean that "no defects occurred", "the reflaring crack rate was 30% or less", and "the reflaring crack rate was more than 30%", respectively. The reflaring crack rate was determined by the following formula:

$$\text{Reflaring crack rate } (\%) = \frac{\text{Number of collars having cracks}}{\text{Total number of collars tested}} \times 100.$$

As can be seen from Table 3, the sheets according to the present invention were successfully formed by any of drawless and combination processes without the occurrence of reflaring cracks or other defects during the forming of collar. In contrast, the comparative or conventional sheets were inferior to the present inventive sheets in one or both of the drawless and combination formability.

It should be noted that the present inventive sheets also have an improved electrical conductivity and mechanical strength in comparison with the comparative or conventional sheets.

As herein described above, the present invention thus provides an aluminum alloy sheet and a process of producing the same, in which a cross fin, particularly the collar thereof, can be successfully formed by any of the drawless and combination processes, i.e., the present inventive sheet has a high formability such that a cross fin having a large fin pitch applicable to any type of heat media pipes having various sizes can be successfully formed by a simplified production process which is easy to manage and also reduces the production cost, and by using less viscous volatile lubricants causing no substantial environmental pollution.

What is claimed is:

1. A continuous-cast and cold-rolled aluminum alloy sheet for a cross fin, characterized by:

a chemical composition consisting of not less than 0.05 wt % and less than 0.30 wt % Fe, more than 0.03 wt % and not more than 0.08 wt % Mn, grain refining agents composed of 0.001 wt % to 0.02 wt % Ti and not more than 0.002 wt % B, and the balance of Al and unavoidable impurities including less than 0.15 wt % Si;

a microstructure substantially composed of subgrains; and an electrical conductivity of 55% IACS or more.

2. A process of producing a continuous-cast and cold-rolled aluminum alloy sheet for a cross fin, characterized by the steps of:

preparing an aluminum alloy melt having a chemical composition consisting of not less than 0.05 wt % and less than 0.30 wt % Fe, more than 0.03 wt % and not more than 0.08 wt % Mn, grain refining agents composed of 0.001 wt % to 0.02 wt % Ti and not more than 0.002 wt % B and the balance of Al and unavoidable impurities including less than 0.15 wt % Si;

continuous-casting the aluminum alloy melt to form a cast sheet having a sheet thickness of not more than 30 mm; and cold-rolling the cast sheet at a reduction of 90% or more, followed by a temper annealing at a temperature of from 250 to 300° C. for a holding time of 2 hours or more.

* * * * *